US005630929A

United States Patent [19]

Oshima et al.

[11] Patent Number: 5,630,929

[45] Date of Patent: May 20, 1997

[54] HIGHLY CORROSION-RESISTANT ZINCATE TYPE ZINC-IRON-PHOSPHORUS ALLOY PLATING BATH AND PLATING METHOD USING THE PLATING BATH

[75] Inventors: Katsuhide Oshima; Satoshi Yuasa; Junko Ozawa, all of Tokyo, Japan

[73] Assignee: Dipsol Chemicals Co., Ltd., Tokyo, Japan

[21] Appl. No.: 451,166

[22] Filed: May 26, 1995

[30] Foreign Application Priority Data

Oct. 17, 1994 [JP] Japan ..... 6-250305

[51] Int. Cl.[6] ..... C25D 3/56; C23C 16/00; C23C 18/00; C23C 20/00

[52] U.S. Cl. ..... 205/245; 205/255; 205/258; 205/259; 106/1.25; 106/1.27

[58] Field of Search ..... 205/170, 176, 205/177, 178, 238, 245, 255, 258, 259; 106/1.25, 1.27

[56] References Cited

U.S. PATENT DOCUMENTS 4,541,903 9/1985 Kyono et al. ..... 205/245

5,395,510 3/1995 Kikuchi et al. ..... 205/138

FOREIGN PATENT DOCUMENTS 59-211590 11/1984 Japan .
60-96790 5/1985 Japan .
63-14071 3/1988 Japan .
63-42717 8/1988 Japan .

*Primary Examiner*—Kathryn Gorgos
*Assistant Examiner*—Edna Wong
*Attorney, Agent, or Firm*—Oblon, Spivak, McClelland, Maier & Neustadt, P.C.

[57] ABSTRACT

A zinc-iron-phosphorus alloy-plating bath having a pH of not less than 13 and containing iron, phosphorus and zinc sources in amounts required for electro-depositing a zinc-iron-phosphorus alloy film having an iron content ranging from 0.1 to 30% by weight, a phosphorus content ranging from 0.001 to 1.5% by weight and the balance of zinc, and an auxiliary agent for depositing phosphorus. The use of the alkaline plating bath permits the formation of a zinc-iron-phosphorus alloy film, through plating, excellent in lustre of deposit, throwing power and corrosion resistance and the reduction in corrosion of the plating equipment and also permits the formation of a film, through plating, having excellent adhesion as an undercoat for painting.

30 Claims, No Drawings

HIGHLY CORROSION-RESISTANT ZINCATE TYPE ZINC-IRON-PHOSPHORUS ALLOY PLATING BATH AND PLATING METHOD USING THE PLATING BATH

BACKGROUND OF THE INVENTION

The present invention relates to an alkali plating bath effective for forming a zinc-iron-phosphorus alloy film through plating, a plating method using the plating bath and a method for forming a chromate film on the alloy film.

A steel plate provided thereon with a zinc-iron-phosphorus alloy film formed through plating exhibits various excellent properties. More specifically, the plate not only exhibits, for instance, excellent weldability, acceptability of a conversion treatment and compatibility with various coating layers comparable to those of a steel plate plated with a zinc-iron alloy film, but also has excellent corrosion resistance even after coating and, in particular, the steel plate is not susceptible to local corrosion and is excellent in resistance to pore-formation, due to the incorporation of phosphorus into the plated film.

For this reason, there have been proposed a variety of plating bath compositions in which the content of iron is variously changed. For instance, Japanese Un-examined Patent Publication (hereunder referred to as "J.P. KOKAI") No. Sho 59-211590 discloses a plating composition which comprises 0.0003 to 0.5% by weight of phosphorus, 0.01 to 5% by weight of iron and the balance of zinc; Japanese Examined Patent Publication (hereunder referred to as "J.P. KOKOKU") No. Sho 63-14071 discloses a plating composition which comprises 0.0003 to 0.5% by weight of phosphorus, 5 to 30% by weight of iron and the balance of zinc; and J.P. KOKOKU No. Sho 63-42717 discloses a plating composition which comprises 0.0003 to 0.5% by weight of phosphorus, 7 to 35% by weight of iron and the balance of zinc. All of the plated films disclosed in these patents are formed from acidic baths whose pH is 3 or 3.5.

However, the foregoing plating techniques using these acidic plating baths are developed for fast and continuous plating of steel plates and for forming an undercoat for painting and they, accordingly, suffer from a problem in that they are unsuitable for plating general parts which must satisfy the requirements for high glossiness and an excellent acceptability of uniform electrodeposition (in particular, the acceptability of the low current density portions). In addition, these acidic plating baths contain a large amount of strongly corrosive chlorides such as iron chloride, zinc chloride, ammonium chloride and/or potassium chloride and therefore, these techniques also suffer from a problem in that the plating installation is susceptible to corrosion due to the action of these chloride and corrosive gases generated during plating operations.

SUMMARY OF THE INVENTION

Accordingly, it is an object of the present invention to provide a plating bath which permits the formation of, through plating, a zinc-iron-phosphorus alloy film excellent in lustre of deposit, throwing power and corrosion resistance and which does not cause corrosion of the plating equipment.

Another object of the present invention is to provide a method for forming, through plating, a zinc-iron-phosphorus alloy film which is excellent in lustre of deposit, throwing power and corrosion residence.

These and other objects of the present invention will be apparent from the following description and examples.

The present invention has been developed on the basis of the following finding that if the pH value of the plating bath is set at a level of not less than 13, almost no co-deposition of phosphorus in the resulting plated film is observed even when phosphoric acid salts such as trisodium phosphate, disodium phosphate and/or sodium hypophosphite is used as sources for phosphorus, while if an auxiliary agent for depositing phosphorus coexists in the plating bath, phosphorus atoms can be incorporated into the resulting plated film and thus the foregoing object of the present invention can effectively be accomplished.

According to an aspect of the present invention, there is provided an alkaline zinc-iron-phosphorus alloy-plating bath which has a pH of not less than 13 and which comprises iron, phosphorus and zinc sources in amounts required for electro-depositing a zinc-iron-phosphorus alloy film having an iron content ranging from 0.1 to 30% by weight, a phosphorus content ranging from 0.001 to 1.5% by weight and the balance of zinc, as well as an auxiliary agent for depositing phosphorus.

According to another aspect of the present invention, there is provided a plating method which comprises the steps of immersing a subject to be plated in the aforementioned plating bath and then passing an electric current through the subject serving as a cathode to thus electro-deposit, on the subject, a zinc-iron-phosphorus alloy film having an iron content ranging from 0.1 to 30% by weight, a phosphorus content ranging from 0.001 to 1.5% by weight and the balance of zinc.

DESCRIPTION OF THE PREFERRED EMBODIMENTS

The present invention will now be described in more detail below.

The plating bath of the present invention is a strongly alkaline plating bath having a pH of not less than 13 and comprises a conventional alkaline zincate type zinc-plating bath as a basic bath to which an auxiliary agent for depositing phosphorus is added to thus make the electro-deposition of iron·phosphate ions possible.

In the present invention, any zinc compound may be used as the zinc source so far as it can be dissolved in an alkaline bath having a pH of not less than 13. Specifically, the zinc sources usable herein are preferably, for instance, zinc white (ZnO) and the zinc sources are desirably used in such an amount that the Zn concentration of the resulting plating bath ranges from 2 to 40 g/l and preferably 6 to 15 g/l.

In the present invention, any iron compound may be used as the iron source so far as it can be dissolved in an alkaline bath having a pH of not less than 13. Specifically, the iron sources usable herein are preferably, for instance, iron sulfate, iron chloride, iron hydroxide, iron phosphate, iron oxalate, iron citrate and mixture thereof. The iron sources are desirably used in such an amount that the Fe concentration of the resulting plating bath ranges from 0.02 to 10 g/l and preferably 0.2 to 1 g/l.

In the present invention, any phosphorus atom-containing compound may be used as the phosphorus source so far as it can be dissolved in an alkaline bath having a pH of not less than 13, but preferably used are, for instance, hypophosphorous acid or salts thereof and phosphorous acid or salts thereof which can be used alone or in any combination. In this respect, preferred salts of hypophosphorous acid and phosphorous acid are sodium and potassium salts. The phosphorus sources are desirably used in an amount ranging from 1.0 to 60 g/l and preferably 5 to 30 g/l as expressed in terms of the amount of phosphorus.

The alkaline plating bath of the present invention also comprises an auxiliary agent for depositing phosphorus in addition to the foregoing compounds. Examples of such auxiliary agents for depositing phosphorus are alkylenepolyamines having 4 to 12 carbon atoms such as diethylenetriamine and triethylenetetramine; reaction products of alkyleneamines having 4 to 12 carbon atoms with alkylene oxides having 2 to 3 carbon atoms; reaction products of alkyleneamines having 4 to 12 carbon atoms with epihalohydrins; alkanolamines having 2 to 6 carbon atoms such as triethanolamine; aminopolycarboxylic acids having 6 to 14 carbon atoms and salts thereof such as ethylenediaminetetraacetic acid; oxycarboxylic acid salts having 2 to 8 carbon atoms such as tartaric acid salts, gluconic acid salts and glycolic acid salts, which may be used alone or in any combination, with triethanolamine, the reaction products of alkyleneamines with alkylene oxides being preferred. The concentration of these auxiliary agents in the plating bath is not limited to a specific range, but preferably ranges from 10 to 200 g/l and more preferably 10 to 80 g/l. This is because if the concentration is less than 10 g/l, the stability of the resulting bath is insufficient, while the use thereof in an amount of more than 200 g/l is not preferred from the viewpoint of treatment of waste liquor and is unfavorable from the economical standpoint.

The plating bath of the present invention is an alkaline plating bath which comprises the foregoing compounds as essential components and the balance of water and has a pH of not less than 13. The pH value of such a strongly alkaline bath can easily be adjusted by the addition of an alkali hydroxide such as NaOH or KOH. The amount of the alkali hydroxide to be added preferably ranges from 30 to 200 g/l.

In addition, the plating bath of the present invention may comprise a brightener. As such a brightener, there may be used, for instance, those used in the Zn or Zn alloy-plating bath (such as those manufactured and sold by Dipsol Company under the trade names of NZ-71S and NZ-65S).

According to the plating method of the present invention, a subject to be plated such as a steel plate, or a copper or copper alloy plate is immersed in the foregoing plating bath and then an electric current is passed through the subject serving as a cathode and an anode such as an iron or zinc plate at a voltage ranging from 3 to 20 V, a cathodic current density ranging from 0.4 to 10 A/dm$^2$, a temperature ranging from 20° to 35° C., for 5 to 30 minutes to thus electrodeposit, on the subject, a zinc-iron-phosphorus alloy film having a thickness ranging from 3 to 20 μm which comprises 0.1 to 30% by weight (hereunder simply referred to as "%" unless otherwise specified), preferably 1.5 to 15% of iron, 0.001 to 1.5%, preferably 0.001 to 0.2% of phosphorus and the balance of zinc.

In the present invention, a chromate film may further be formed on the zinc-iron-phosphorus alloy film thus formed. This results in the formation of high corrosion-resistant-high heat resistant and high corrosion-resistant plated layer as compared with the conventional products obtained by plating zinc and a zinc-iron alloy and then subjected to a chromate treatment. The chromate film may be formed by the usual method such as those disclosed in, for instance, J.P. KOKOKU No. Sho 38-1110. In this respect, the thickness of the chromate film may be arbitrarily selected, but preferably ranges from about 0.1 to 2 μm.

The use of the alkaline plating bath according to the present invention permits the formation of a zinc-iron-phosphorus alloy film, through plating, excellent in lustre of deposit, throwing power and corrosion resistance and the reduction in corrosion of the plating equipment.

Moreover, the plating bath of the invention also permits the formation of a film, through plating, having excellent adhesion as an undercoat for subsequent painting. Therefore, the present invention is effective as a surface-treating technique used in various fields such as motorcar industries which require high heat resistance and high corrosion resistance.

The present invention will hereunder be explained in more detail with reference to the following non-limitative working Examples.

EXAMPLE 1

In this Example, there were prepared alkaline plating baths each having a pH of not less than 13 and comprising the following bath components and the balance of water.

| Component | Amount (g/l) |
|---|---|
| Zn | 10 |
| iron | 0.0 to 3.3 (see Table 1; ferric chloride was used) |
| NaOH | 130 |
| sodium phosphite | 30 |
| sodium gluconate | 10 |
| auxiliary agent for depositing phosphorus | 60 |
| brightener | 6 (ml) |

The auxiliary agent for depositing phosphorus used herein was the reaction product of diethylenetriamine with epichlorohydrin (hereunder simply referred to as "RP") and the brightener herein used was NZ-71S (trade name; available from Dipsol Company).

A copper plate serving as a cathode and an iron plate serving as an anode were immersed in the foregoing plating bath and then an electric current was passed through these electrodes at a voltage of 7 V, a current density of 3 A/dm$^2$, a temperature of 27° C. for 30 minutes. The film deposited on the copper plate was inspected for the contents of Zn and Fe by an atomic absorption spectrophotometer and the content of P by an absorption spectrophotometer. The results thus obtained are summarized in the following Table 1.

TABLE 1

| Fe Concn. in Bath | Fe % | P % | Zn % |
|---|---|---|---|
| 0.0 | 0.0 | 0.0 | 100 |
| 0.4 g/l | 4.2 | 0.3 | balance |
| 1.2 g/l | 11.6 | 0.3 | balance |
| 3.3 g/l | 28.5 | 0.3 | balance |

EXAMPLE 2

In this Example, there were prepared alkaline plating baths each having a pH of not less than 13 and comprising the following bath components and the balance of water.

| Component | Amount (g/l) |
|---|---|
| Zn | 10 |
| iron | 3.3 |
| NaOH | 130 |
| sodium hypophosphite | 30 |
| sodium gluconate | 10 |
| auxiliary agent for depositing phosphorus(RP) | 23~190 (see Table 2) |

The same procedures used in Example 1 were repeated except that the concentration of the auxiliary agent for depositing phosphorus in the plating bath was variously changed to thus deposit a film on a copper plate and the composition of the resulting film was analyzed in the same manner used in Example 1. The results thus obtained are summarized in the following Table 2.

TABLE 2

| RP Concn. in Bath | Fe % | P % | Zn % |
|---|---|---|---|
| 23 g/l | 30 | 0.1 | balance |
| 60 g/l | 29 | 0.3 | balance |
| 115 g/l | 27 | 0.5 | balance |
| 190 g/l | 23 | 0.9 | balance |

The results listed in Table 2 clearly indicate that the rate of phosphorus co-deposition increases in proportion to the concentration of the auxiliary agent for depositing phosphorus.

EXAMPLE 3

In this Example, there were prepared alkaline plating baths each having a pH of not less than 13 and comprising the following bath components and the balance of water.

| Component | Amount (g/l) |
|---|---|
| Zn | 10 |
| NaOH | 130 |
| sodium hypophosphite | 30 |
| sodium gluconate | 15 |
| Fe | 1.0 |
| auxiliary agent for depositing phosphorus (RP) (kinds thereof used are listed in Table 2) | 60 |
| brightener: NZ-71S | 6 (ml) |

The same procedures used in Example 1 were repeated except that the kinds of the auxiliary agent for depositing phosphorus used in the plating baths were variously changed to thus deposit each corresponding film on a copper plate and the composition of the resulting film was analyzed in the same manner used in Example 1. The results thus obtained are summarized in the following Table 3.

TABLE 3

| Kind of Auxiliary Agent | Concn. (g/l) | Fe % | P % |
|---|---|---|---|
| pentaethylenehexamine | 60 | 20 | 0.1 |
| triethanolamine | 60 | 20 | 0.4 |
| tartaric acid | 60 | 20 | 0.25 |
| ethylenediaminetetraacetic acid | 60 | 20 | 0.20 |
| sodium gluconate | 60 | 20 | 0.25 |
| RP | 60 | 29 | 0.3 |

The results listed in Table 3 clearly indicate that a large amount of phosphorus is deposited on a subject in the plating baths to which triethanolamine and the reaction product of diethylenetriamine with epichlorohydrin are added and that these plating baths can easily provide zinc-iron-phosphorus alloy films.

EXAMPLE 4

In this Example, there were prepared alkaline plating baths each having a pH of not less than 13 and comprising the following bath components and the balance of water.

| Component | Amount (g/l) |
|---|---|
| Zn | 8 |
| NaOH | 130 |
| Fe | 3.3 |
| hypophosphorous acid (concentrations are listed in Table 4) | 1~60 |
| auxiliary agent for depositing phosphorus | 200 |
| brightener: NZ-71S | 6 (ml) |

The same procedures used in Example 1 were repeated except that the concentration of hypophosphorous acid in the plating baths was variously changed to thus deposit each film on a copper plate and the composition of the resulting film was analyzed in the same manner used in Example 1. The results thus obtained are summarized in the following Table 4.

TABLE 4

| Concn. of Hypophosphorous Acid | Fe % | P % | Zn % |
|---|---|---|---|
| 1 g/l | 25 | 0.05 | balance |
| 5 g/l | 25 | 0.24 | balance |
| 10 g/l | 24 | 0.63 | balance |
| 20 g/l | 24 | 0.85 | balance |
| 30 g/l | 23 | 0.9 | balance |
| 60 g/l | 21 | 1.1 | balance |

The results listed in Table 4 clearly indicate that the phosphorus content in the resulting film is apt to increase in proportion to the concentration of hypophosphorous acid and varies within the range of from 0.001 to 1.5% depending on the iron content and the concentration of the auxiliary agent for depositing phosphorus.

EXAMPLE 5

In this Example, there were prepared alkaline plating baths each having a pH of not less than 13 and comprising the following bath components and the balance of water.

| Component | Amount (g/l) |
|---|---|
| Zn (concentrations are listed in Table 5) | 4.8 to 8.0 |
| NaOH | 120 |
| Fe | 3.3 |
| sodium hypophosphite | 60 |
| auxiliary agent for depositing phosphorus(RP) | 100 |
| brightener: NZ-71S | 6 (ml) |

The same procedures used in Example 1 were repeated except that the concentration of Zn in the plating baths was variously changed to thus deposit each film on a copper plate and the composition of the resulting film was analyzed in the same manner used in Example 1. The results thus obtained are summarized in the following Table 5.

TABLE 5

| Concn. of Zn | Fe % | P % | Zn % |
|---|---|---|---|
| 8.0 g/l | 22 | 0.56 | balance |
| 7.0 g/l | 23 | 0.73 | balance |
| 6.5 g/l | 27 | 1.00 | balance |
| 6.0 g/l | 28 | 1.22 | balance |
| 5.0 g/l | 30 | 1.53 | balance |

EXAMPLE 6

The same procedures used in Example 1 were repeated except that a plating bath having the following bath composition to form a zinc-iron-phosphorus alloy film or a zinc-iron alloy film (each having a thickness of 10 μm) on a copper plate and then the copper plate was further subjected to a chromate treatment under the following conditions. The resulting chromate films were inspected for the corrosion resistance as determined by an SST test and expressed in terms of red rust-developing times which were compared with one another. As a result, it was found that the phosphorus-containing film formed according to the present invention is improved in the corrosion resistance after the chromate treatment as compared with the chromate-treated film free of phosphorus.

| Component | Amount (g/l) |
|---|---|
| Zn | 10 |
| NaOH | 130 |
| sodium hypophosphite | 30 |
| sodium gluconate | 5 |
| triethanolamine | 5 |
| Fe 0.5% (Fe content of the resulting film) | 0.1 |
| 2.0% (Fe content of the resulting film) | 0.3 |
| brightener: NZ-71S | 6 (ml) |

Method for Chromate Treatment

In case of the plated film having an Fe content of 0.5%, an aqueous chromate bath was used, which comprised 10 g/l of $CrO_3$ and 1 g/l of sulfuric acid.

In case of the plated film having an Fe content of 2.0%, an aqueous chromate bath was used, which comprised 10 g/l of $CrO_3$ and 8 g/l of NaCl.

The results thus obtained are summarized in the following Table 6.

TABLE 6

| Fe % | P % | Zn % | General Corrosion resistance (hr) | Corrosion Resistance Upon Heating at 160° C. for 48 hr (hr) |
|---|---|---|---|---|
| 0.5 | 0 | balance | 1000 | 170 |
| 0.5 | 0.003 | balance | 1800 | 240 |
| 2.0 | 0 | balance | 2000 | 400 |
| 2.0 | 0.04 | balance | 3000 | 530 |
| 6.0 | 0.08 | balance | 3000 | 530 |
| 8.0 | 0.12 | balance | 3000 | 480 |
| 10.0 | 0.15 | balance | 1800 | 400 |
| 15.0 | 0.20 | balance | 1200 | 170 |

What is claimed is:

1. A zinc-iron-phosphorous alloy-plating bath having a pH of not less than 13 and comprising iron, phosphorous and zinc sources in amounts required for electro-depositing a zinc-iron-phosphorous alloy film having an iron content ranging from 0.1 to 30% by weight, a phosphorous content ranging from 0.001 to 1.5% by weight and a balance of zinc, and an auxiliary agent for depositing phosphorous selected from the group consisting of alkylenepolyamines having 4 to 12 carbon atoms; reaction products of alkyleneamines having 4 to 12 carbon atoms with alkylene oxides having 2 to 3 carbon atoms; reaction products of alkyleneamines each having 4 to 12 carbon atoms with epihalohydrins; alkanolamines having 2 to 6 carbon atoms; aminopolycarboxylic acids having 6 to 14 carbon atoms and salts thereof; and oxycarboxylic acids having 2 to 8 carbon atoms and salts thereof.

2. The plating bath of claim 1 wherein the phosphorus source is selected from the group consisting of hypophosphorous acid, phosphorous acid and salts thereof and a concentration thereof ranges from 1 to 60 g/l as expressed in terms of the amount of phosphorus.

3. The plating bath of claim 2, wherein the concentration of the phosphorus source ranges from 5 to 30 g/l as expressed in terms of the amount of phosphorus.

4. The plating bath of claim 1 wherein the concentration of the auxiliary agent for depositing phosphorus ranges from 10 to 70 g/l.

5. The plating bath of claim 1 wherein the auxiliary agent for depositing phosphorus is selected from the group consisting of triethanolamine, and the reaction products of alkyleneamines with alkylene oxides.

6. The plating bath of claim 1 wherein a concentration of the zinc source ranges from 2 to 40 g/l as expressed in terms of the amount of zinc; a concentration of the iron source ranges from 0.02 to 10 g/l as expressed in terms of the amount of iron; and a concentration of the phosphorus source ranges from 1.0 to 60 g/l as expressed in terms of the amount of phosphorus.

7. The plating bath of claim 1, wherein the iron source is selected from the group consisting of iron sulfate, iron chloride, iron hydroxide, iron phosphate, iron oxalate and iron citrate; and is used in an amount of from 0.02 to 10 g/l.

8. The plating bath of claim 1, wherein the zinc source is zinc oxide; and is used in an amount of from 2 to 40 g/l.

9. The plating bath of claim 1, wherein said auxiliary agent is a reaction product of said alkyleneamines having 4 to 12 carbon atoms with alkylene oxides having 2 to 3 carbon atoms.

10. A method for electro-depositing a zinc-iron-phosphorus alloy film, comprising:

a) immersing an object to be plated in a plating bath having a pH of not less than 13, and comprising 2 to 40 g/l of a zinc source as expressed in terms of the amount of zinc, 0.02 to 10 g/l of an iron source as expressed in terms of the amount of iron, 1.0 to 60 g/l of a phosphorus source as expressed in terms of the amount of phosphorus, and 10 to 200 g/l of an auxiliary agent for depositing phosphorus, which is selected from the group consisting of alkylenepolyamines having 4 to 12 carbon atoms, reaction products of alkyleneamines having 4 to 12 carbon atoms with alkylene oxides having 2 to 3 carbon atoms, reaction products of alkyleneamines each having 4 to 12 carbon atoms with epihalohydrins, alkanolamines having 2 to 6 carbon atoms, aminopolycarboxylic acids having 6 to 14 carbon atoms and salts thereof, and oxycarboxylic acids having 2 to 8 carbon atoms and salts thereof; and b) passing an electric current through the object serving as a cathode to electro-deposit, on the object, a zinc-iron-phosphorus alloy film having an iron content ranging from 0.1 to 30% by weight, a phosphorus content ranging from 0.001 to 1.5% by weight and a balance of zinc.

11. The method of claim 10, wherein the electro-depositing is conducted at a voltage ranging from 3 to 20 V, a cathodic current density ranging from 0.4 to 10 A/dm$^2$, and a temperature ranging from 20° to 35° C. for 5 to 30 minutes.

12. The method of claim 11, which further comprises the step of forming a chromate film on the zinc-iron-phosphorus alloy film.

13. The method of claim 12, wherein the chromate film is formed having a thickness of about 0.1 to 2 μm on the zinc-iron-phosphorus alloy film.

14. The method of claim 10, wherein said zinc source is zinc white.

15. The method of claim 10, wherein said zinc source is used in an amount of 6 to 15 g/l.

16. The method of claim 10, wherein said iron source is selected from the group consisting of iron sulfate, iron chloride, iron hydroxide, iron phosphate, iron oxalate and iron citrate.

17. The method of claim 10, wherein said iron source is used in an amount of 0.2 to 1 g/l.

18. The method of claim 10, wherein said phosphorus source is selected from the group consisting of hypophosphorous acid, potassium salt of hypophosphorous acid, sodium salt of hypophosphorus acid, phosphorus acid, potassium salt of phosphorus acid and sodium salt of phosphorus acid.

19. The method of claim 10, wherein said phosphorus source is used in an amount of 5 to 30 g/l.

20. The method of claim 10, wherein said alkylenepolyamines having 4 to 12 carbon atoms are selected from the group consisting of diethylenetriamine and triethylenetetramine.

21. The method of claim 10, wherein said alkanonolamines having 2 to 6 carbon atoms is triethanolamine.

22. The method of claim 10, wherein said aminopolycarboxylic acids having 6 to 14 carbon atoms is ethylenediaminetetracetic acid.

23. The method of claim 10, wherein said oxycarboxylic acid salts having 2 to 8 carbon atoms are selected from the group consisting of tartaric acid salts, gluconic acid salts and glycolic acid salts.

24. The method of claim 10, wherein said auxiliary agent for depositing phosphorus is used in an amount of 10 to 80 g/l.

25. A zinc-iron-phosphorus alloy-plating bath having a pH of not less than 13 and comprising 2 to 40 g/l of a zinc source expressed in terms of the amount of zinc, 0.02 to 10 g/l of an iron source expressed in terms of the amount of iron, 1.0 to 60 g/l of a phosphorus source expressed in terms of the amount of phosphorus and 10 to 200 g/l of an auxiliary agent for depositing phosphorus selected from the group consisting of alkylenepolyamines having 4 to 12 carbon atoms; reaction products of alkyleneamines having 4 to 12 carbon atoms with alkylene oxides having 2 to 3 carbon atoms; reaction products of alkyleneamines each having 4 to 12 carbon atoms with epihalohydrins; alkanolamines having 2 to 6 carbon atoms; aminopolycarboxyllic acids having 6 to 14 carbon atoms and salts thereof; and oxycarboxylic acids having 2 to 8 carbon atoms and salts thereof so as to electro-deposit a zinc-iron-phosphorus alloy film having an iron content ranging from 0.1 to 30% by weight, a phosphorus content ranging from 0.001 to 1.5% by weight and a balance of zinc.

26. The plating bath of claim 25, wherein the auxiliary agent for depositing phosphorus is selected from the group consisting of triethanolamine, and the reaction products of alkyleneamines with alkylene oxides.

27. The plating bath of claim 25, wherein the zinc-iron-phosphorus alloy film has an iron content ranging from 1.5 to 15% by weight, a phosphorus content ranging from 0.001 to 0.2% by weight and a balance of zinc.

28. The plating bath of claim 25, wherein the iron source is selected from the group consisting of iron sulfate, iron chloride, iron hydroxide, iron phosphate, iron oxalate and iron citrate; and is used in an amount of from 0.02 to 10 g/l.

29. The plating bath of claim 25, wherein the zinc source is zinc oxide; and is used in an amount of from 2 to 40 g/l.

30. The plating bath of claim 25, wherein said auxiliary agent is a reaction product of said alkyleneamines having 4 to 12 carbon atoms with alkylene oxides having 2 to 3 carbon atoms.

* * * * *